US006564905B1

(12) United States Patent
Yukioka

(10) Patent No.: US 6,564,905 B1
(45) Date of Patent: May 20, 2003

(54) LUBRICATION SYSTEM FOR A MARINE ENGINE

(75) Inventor: Masahiro Yukioka, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 5 days.

(21) Appl. No.: 09/929,846

(22) Filed: Aug. 14, 2001

(51) Int. Cl.[7] ..... F01M 11/00

(52) U.S. Cl. ..... 184/6.28; 123/90.31; 123/192.2; 123/196 R

(58) Field of Search ..... 184/6.28; 123/90.27, 123/90.31, 192, 192.2, 195 C, 195 H, 196 R

(56) References Cited

U.S. PATENT DOCUMENTS

| | | | | |
|---|---|---|---|---|
| 5,190,005 A | * | 3/1993 | Saito et al. | 123/196 R |
| 5,524,581 A | | 6/1996 | Rush et al. | 123/90 |
| 5,687,686 A | | 11/1997 | Takahashi | 123/195 |
| 5,704,819 A | | 1/1998 | Isogawa | 440/88 |
| 5,778,847 A | | 7/1998 | Takahashi et al. | 123/195 |
| 5,778,848 A | | 7/1998 | Takahashi et al. | 123/196 |
| 5,860,402 A | * | 1/1999 | Sakurai et al. | 123/196 R |
| 5,870,991 A | | 2/1999 | Mineno | 123/196 |
| 5,876,188 A | | 3/1999 | Okamoto | 417/364 |
| 5,975,970 A | | 11/1999 | Daikoku | 440/88 |
| 6,041,892 A | | 3/2000 | Watanabe et al. | 184/6 |
| 6,189,501 B1 | | 2/2001 | Fujii et al. | 123/195 |
| 6,192,853 B1 | | 2/2001 | Natsume | 123/196 |
| 6,367,442 B1 | * | 4/2002 | Takayanagi | 123/196 W |

FOREIGN PATENT DOCUMENTS

| | | | | |
|---|---|---|---|---|
| JP | 2001263020 A | * | 9/2001 | F01M/1/02 |

* cited by examiner

*Primary Examiner*—Chong H. Kim
(74) *Attorney, Agent, or Firm*—William D. Lanyi

(57) ABSTRACT

Installation and assembly of an outboard motor made in accordance with the present invention is significantly simplified. Since no spline connection between the sleeve and the crankshaft is required, the engine can be attached to the adapter plate in a much more simplified procedure as long as the pairs of pins are placed in non interfering positions. Because the sleeve of the present invention is driven directly by the crankshaft, without involvement of the driveshaft, the present invention allows the driveshaft to be installed into and through the adapter plate more easily than systems known in the prior art.

14 Claims, 6 Drawing Sheets

LUBRICATION SYSTEM FOR A MARINE ENGINE

BACKGROUND OF THE INVENTION

1. Field of the Invention

The present invention is generally related to a lubrication system for a marine engine and, more particularly, to a lubrication system which displaces the axis of rotation of the oil pump rotor from the axis of rotation of an output shaft of the engine which drives the oil pump.

2. Description of the Prior Art

Many different types of lubrication systems are well known for use in conjunction with four cycle engines. In addition, several types of oil pump configurations and locations in association with engines are known to those skilled in the art.

U.S. Pat. No. 6,192,853, which issued to Natsume on Feb. 27, 2001, describes an oil pump for a four cycle outboard motor. The outboard motor oil pump driving arrangement is disclosed wherein the oil pump is driven by a spline connection position between the engine crankshaft and the driveshaft. There is a spline connection also between the crankshaft and the driveshaft and this spline connection is axial spaced from the spline connection to the pump drive element with the splines being spaced from each other by a non-spline section so as to reduce stress risers and to make assembly and disassembly easy even if the parts are deformed.

U.S. Pat. No. 5,975,970, which issued to Daikoku on Nov. 2, 1999, describes an oil pump unit for an outboard motor. The outboard motor comprises an engine holder arranged to be mounted to a hull, an engine disposed in an upper portion of the engine holder in a mounted state thereof, an oil pan disposed in a lower portion of the engine holder, a crankshaft vertically disposed in the engine, a cam shaft disposed to extend in parallel to the crankshaft, and a lubricating device including an oil pump unit disposed to a lower surface of the engine holder and adapted to circulate an oil in the engine. The oil pump unit comprises a pump case having a case body to be mounted to the engine holder, a pump driveshaft operatively connected to the cam shaft for operating the oil pump disposed on the lower surface of the engine holder, and suction and discharge ports. The pump driveshaft is detachably connected to the cam shaft to be slidable in a vertical direction in the mounted state, and the suction port and the discharge port operatively communicate with the suction and discharge ports of the engine, respectively.

U.S. Pat. No. 6,189,501, which issued to Fujii et al on Feb. 20, 2001, describes a lubricating apparatus for an engine. The lubricating apparatus of an outboard motor comprises an oil pan disposed in a lower portion of an engine and providing with an oil accumulating tank, an oil strainer for straining an oil accumulated in the oil accumulating tank, an oil pump for supplying strained oil to an inside portion of the engine, the oil strainer and the oil pump being mounted to a structural member such as a pump case disposed above the oil pan so as to be connected to each other, and an oil suction pipe extending from the oil strainer to a bottom portion of the oil accumulating tank.

U.S. Pat. No. 5,778,847, which issued to Takahashi et al on Jul. 14, 1998, describes a four cycle outboard motor. The outboard motor has a high performance V-type twin overhead cam four cycle internal combustion engine. The oil reservoir for the engine is disposed in a driveshaft housing below the engine and an oil pump is driven off the lower end of the engine crankshaft for circulating the oil from the oil tank to the engine. The oil supply system for the engine includes a vertically extending main gallery and a drain passage which extends in parallel side-by-side relationship and which are disposed over the oil tank for ease of oil return. The exhaust and cooling system for the engine is configured so as to minimize heat transfer between the exhaust system and the lubricating system and to maintain a compact assembly.

U.S. Pat. No. 6,041,892, which issued to Watanabe et al on Mar. 28, 2000, describes an oil pump for an outboard motor. The oil pump for a lubricating system of an outboard motor is disclosed. The motor has a cowling defining an engine compartment, a water propulsion device, and a guide member having an upper surface and a lower surface, the guide member positioned in the cowling and generally dividing the engine compartment into an upper part and a lower part. An engine is positioned in the upper part of the engine compartment within the cowling and has an output shaft arranged to drive the water propulsion device. The lubricating system includes an oil pan positioned below the guide member and an oil passage leading from the pan through the guide member. The oil pump is positioned in the upper part of the engine compartment, but below the engine, and is driven by a lower end of the output shaft of the engine which extends below the engine, the oil pump having an oil inlet in communication with the oil passage through the guide member.

U.S. Pat. No. 5,876,188, which issued to Okamoto on Mar. 2, 1999, describes an oil pump arrangement for a four cycle outboard motor. The oil pump for an engine of an outboard motor of the type including a block with an output shaft extending therefore is disclosed. The oil pump includes an oil pan comprising an outer housing defining an oil chamber and a pumping chamber therein. The oil pump includes a pumping mechanism for pumping oil from the oil chamber to the engine. The pumping mechanism is positioned within the pumping chamber, with the outer housing defining the pumping chamber acting as a pump housing therefore. The pumping mechanism is positioned on and driven by the output shaft of the engine which extends through the oil and pumping chambers of the oil pan. A recess in the pumping chamber accommodates a flywheel, which is also positioned on and driven by the output shaft of the engine.

U.S. Pat. No. 5,870,991, which issued to Mineno on Feb. 16, 1999, describes a lubricating device for an outboard motor. The outboard motor comprises an engine of a vertical type in which a crankshaft is disposed vertically in an installed state of the engine, an engine holder support the engine, an oil pan which is disposed below the engine through the engine holder and in which an oil is accumulated, and a lubricating device for lubricating the oil from the oil pan to an inside of the engine. The lubricating device comprises an oil pump mounted to a lower side portion of the engine holder and adapted to suck the oil accumulated in the oil pan, an oil suction passage and an oil discharge passage. The oil suction passage and oil discharge passage extend in parallel to each other from the oil pump and are formed integrally with the inside portion of the engine holder.

U.S. Pat. No. 5,778,848, which issued to Takahashi et al on Jul. 14, 1998, describes a four cycle outboard motor lubricating system. A four cycle outboard motor has an oil tank that is disposed at least in part in the driveshaft housing of the outboard motor and an oil pump that is driven off of the lower end of the crankshaft. At least a portion of the conduits for transmitting oil from the oil tank to the oil pump and from the oil pump to the engine for its lubrication are formed integrally in a lower face of the cylinder block.

U.S. Pat. No. 5,704,819, which issued to Isogawa on Jan. 6, 1998, describes an oil pan arrangement for a four cycle outboard motor. The outboard motor has a high performance V-type overhead cam four cycle internal combustion engine. The oil reservoir for the engine is disposed in a driveshaft housing below the engine and an oil pump is driven off the lower end of the engine crankshaft for circulating the oil from the oil tank to the engine. The oil supply system for the engine includes a vertically extending main gallery and a drain passage which extend in parallel side-by-side relationship and which are disposed over the oil tank for ease of oil return. The exhaust and cooling system for the engine is configured so as to minimize heat transfer between the exhaust system and the lubricating system and to maintain a compact assembly.

U.S. Pat. No. 5,687,686, which issued to Takahashi on Nov. 18, 1997, describes a lubricating system for a four cycle outboard motor. The outboard motor embodies an improved lubricating system. The lubricating system drains oil from the cylinder head back to the oil tank, in a manner so as to not add to the length of the engine. In addition, an improved crankcase ventilating system is employed that incorporates a simple baffle arrangement for ensuring that oil thrown by the crankshaft rotation will not pass through the ventilating passage into the cylinder head or escape from the ventilating system.

U.S. Pat. No. 5,524,581, which issued to Rush et al on Jun. 11, 1996, describes an outboard motor with an improved engine lubrication system. The internal combustion engine comprises a cylinder block which defines a cylinder, a crankshaft bearing supported at least in part by the cylinder block, a crankshaft which is rotatably supported by the crankshaft bearing, a piston slidably housed in the cylinder, a connecting rod having one end connected to the piston and an opposite end connected to the crankshaft, a cylinder head mounted on the cylinder block, a camshaft at least partially supported by the cylinder head for rotation relative thereto, an oil pump having an outlet, a first oil conduit communicating between the oil pump outlet and the crankshaft bearing, an oil filter communicating with the first oil conduit for filtering oil only in the first oil conduit, and a second oil conduit communicating between the oil pump outlet and the camshaft. Oil in the second oil conduit is unfiltered between the pump outlet and the camshaft, The patents described above are hereby expressly incorporated by reference in the description of the present invention.

Marine engines known to those skilled in the art typically drive an oil pump with an output shaft of the engine. The axis of rotation of the oil pump rotor is generally coaxial with the axis of rotation of the engine's output shaft used to drive the pump. Certain known arrangements for lubricating marine engines attach the oil pump rotor to the driveshaft of an outboard motor and connect the driveshaft in torque transmitting relation with the crankshaft of the engine. These known arrangements present certain difficulties in manufacturing, assembly, and maintenance. In addition, these known arrangements of oil pump configurations also present problems relating to sealing the various moving components to prevent water from leaking into oil reservoir compartments. It would therefore be beneficial if an oil lubricating system for a marine engine could be provided which improves the operation of the oil pump by placing it close to the oil reservoir, by providing a marine engine lubricating system that is more easily assembled and repaired, and by making the operation of the oil pump independent from the driveshaft of the outboard motor.

SUMMARY OF THE INVENTION

A lubricating system made in accordance with the preferred embodiment of the present invention comprises an oil pump having an inlet port and an outlet port. The oil pump has a rotor supported for rotation about a first vertical axis and the outlet port is connected in fluid communication with at least one lubricating conduit of an engine. An oil reservoir is connected in fluid communication with the inlet port of the oil pump.

An output shaft of the engine is supported by the engine for rotation about a second vertical axis and connected in torque transmitting relation with the rotor of the oil pump. The first and second vertical axes are displaced from each other by a preselected distance and a sleeve is supported for rotation about the second axis. The sleeve is connected in torque transferring relation between the output shaft of the engine and the rotor of the oil pump.

A first torque transferring protrusion is attached to the output shaft of the engine and extends in a direction generally parallel to the second axis. A second torque transferring protrusion is attached to the sleeve, whereby rotation of the first torque transferring protrusion about the second axis causes the first torque transferring protrusion to exert a force against the second torque transferring protrusion. This force causes the sleeve to rotate about the second axis. The first and second torque transferring protrusions can comprise, respectively, first and second pairs of pins.

The lubricating system of the present invention can further comprise a first chain sprocket attached to the sleeve for rotation about the second axis and a second chain sprocket attached to the rotor of the oil pump for rotation about the first axis. A chain is attached to the first and second chain sprockets for transferring torque from the sleeve to the rotor of the oil pump.

The output shaft can be a crankshaft of the engine. A driveshaft is connected in torque transferring relation with the output shaft for rotation about the second axis and the driveshaft can extend through an opening in the sleeve. The oil pump is preferably attached to an adapter plate of the outboard motor and the sleeve is supported by the adapter plate for rotation about the second axis.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
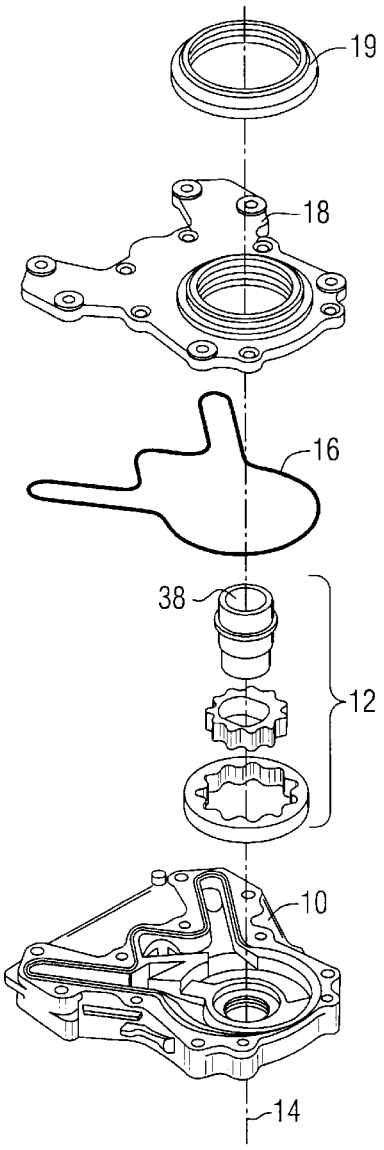
FIG. 1 PRIOR ART
FIG. 1 is an exploded isometric view of a pump known to those skilled in the art.

Throughout the description of the preferred embodiment of the present invention, like components will be identified by like reference numerals.

FIG. 1 is an exploded isometric view of an oil pump known to those skilled in the art and commonly used in conjunction with marine engines of outboard motors. It comprises a base housing 10 within which a three-piece rotor assembly 12 is located within the housing 10 for rotation about centerline 14. A seal 16 is used to prevent leakage between the base housing portion 10 and a cover 18. A top seal 19 is located above the cover 18.

Figure 2:
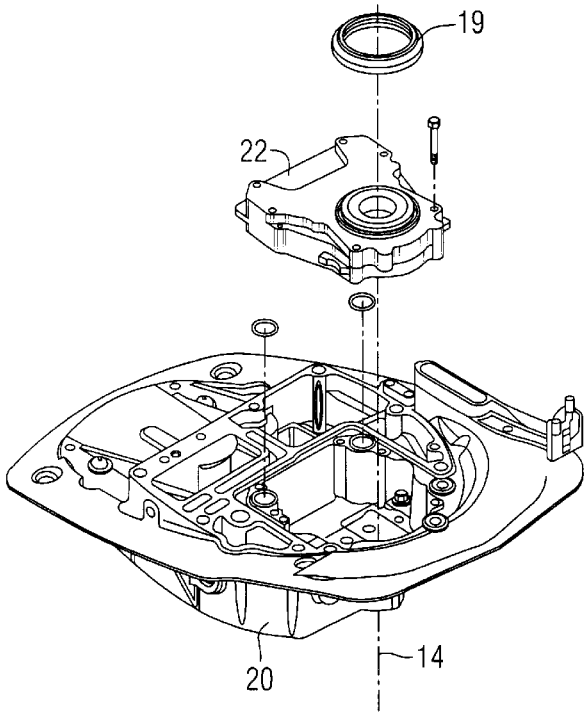
FIG. 2 PRIOR ART
FIG. 2 is an exploded isometric view showing a pump and an adapter plate.

FIG. 2 is an isometric exploded illustration of the pump shown in FIG. 1, associated with an adapter plate 20. The assembled pump 22 is attached to an adapter plate 20 for rotation about axis 14.

The present invention relates to the location of an oil pump in relation to an engine and its output shaft and, furthermore, the present invention relates to the method in which the rotor of the oil pump is driven for rotation about its axis. In order to more clearly understand the differences between the prior art and the present invention, FIGS. 3 and 4 are provided.

Figure 4:
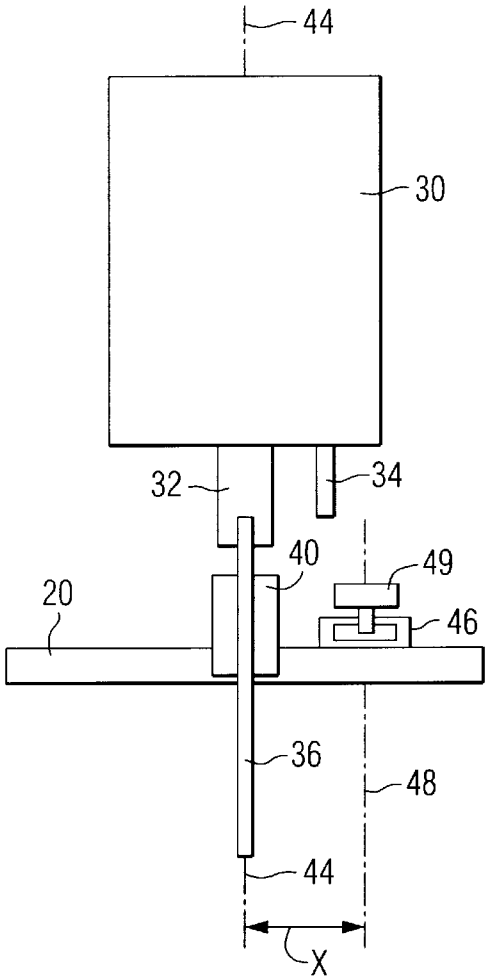
FIG. 4 is a highly schematic representation of an arrangement of components according to the present invention.
Figure 3:
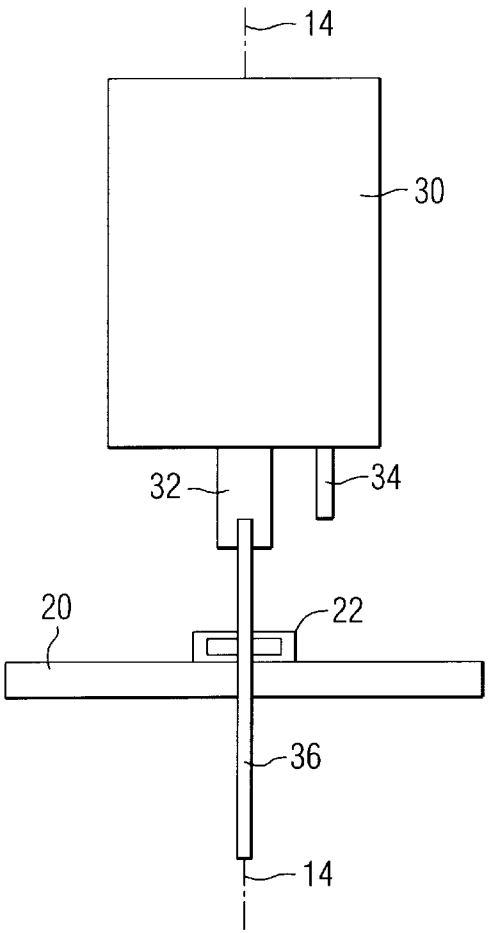
FIG. 3 PRIOR ART
FIG. 3 is a highly schematic representation of the arrangement of components of a lubricating system known to those skilled in the art.

FIGS. 3 and 4 are highly schematic representations of a marine engine lubricating system provided for the purpose of illustrating the differences in the components used to drive the oil pump and the differences in the relative locations and relationships between the elements of the marine lubricating system. FIG. 3 shows the relative positions of an engine 30, an oil pump 22, a crankshaft 32, a cam shaft 34, and an adapter plate 20 which is known to those skilled in the art. As shown in FIG. 3, a driveshaft 36 is attached to the crankshaft 32 and extends through the oil pump 22. With reference to FIGS. 1 and 3, the driveshaft 36 extends through the central opening 38 of the pump rotor assembly 12 and splines on the driveshaft 36 engage splines in the central opening 38 of a cylindrical member within the rotor assembly 12. Rotation of the crankshaft 32 causes the driveshaft 36 to rotate. Rotation of the driveshaft 36 causes the rotor assembly 12 to rotate, thereby pumping oil from an oil reservoir (not shown in FIG. 3) to various lubrication conduits of the engine 30 and associated components.

FIG. 4 shows a lubricating arrangement within the scope of the present invention. The engine 30 has a crankshaft 32 and a camshaft 34. It also has a driveshaft 36 attached to the crankshaft 32 in a manner generally similar to that which is well known to those skilled in the art and used in marine engines similar to the arrangement illustrated in FIG. 3. The present invention differs from the prior art by providing a sleeve 40 which is supported for rotation about the axis 44 of the crankshaft 32 and the driveshaft 36. An oil pump 46 is supported by the adapter plate 20, but at a position which is offset from the axis 44 of the crankshaft 32. The rotational axis 48 of the oil pump 46 is parallel to the axis 44 of the crankshaft 32, but displaced by a dimension X as shown in FIG. 4.

With continued reference to FIG. 4, the rotor of the oil pump 46 is provided with a chain sprocket 49 which allows it to be driven by the sleeve 40, in a manner which will be described in greater detail below. It should be understood that the sleeve 40 is not driven directly by the driveshaft 36, in the manner described in relation to the prior art arrangement of FIG. 3, but directly by the crankshaft 32 in a manner which will be described below.

Figure 5:
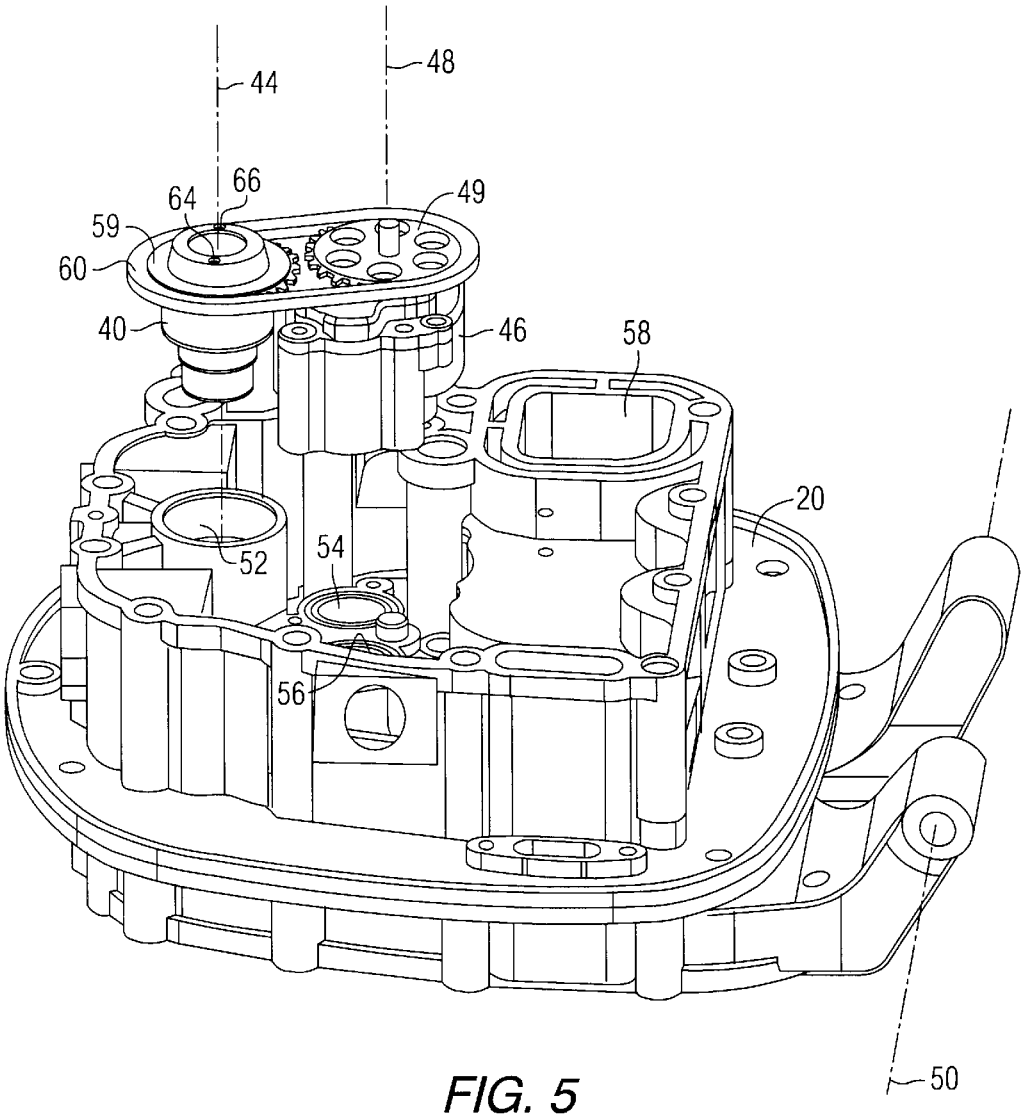
FIG. 5 is an isometric exploded view of an arrangement according to the present invention showing an oil pump and an adapter plate.

FIG. 5 is an isometric exploded view of the present invention associated with an adapter plate 20 of an outboard motor. As is well known to those skilled in the art, the adapter plate 20 is shaped to support an internal combustion engine on its upper portion and is also shaped to support a driveshaft housing below it. The adapter plate 20 is designed to pivot about a trim and tilt axis 50.

In FIG. 5, the sleeve 40 is shown in the exploded view above an opening 52 which is formed in the adapter plate 20 and shaped to receive the sleeve 40 in rotational relation therein. Opening 54, formed through the adapter plate 20, provides a conduit for oil to flow from the oil pump 46 to various lubrication conduits in the engine and associated components. Opening 56, formed through the adapter plate 20, provides a lubrication conduit through which the oil pump 46 draws lubricating fluid from the oil reservoir, or oil sump. The oil pump 46 is shown above these two openings, 54 and 56. When assembled, a bottom surface of the pump 46 is placed in sealing relation with openings 54 and 56 as will be described in greater detail below. Opening 58, shown in FIG. 5, is an exhaust conduit that allows exhaust gases to flow downward from an engine, located above the adapter plate 20, toward the driveshaft housing supported below the adapter plate 20.

The sleeve 40 is provided with a chain sprocket 59. A chain 60 connects the chain sprockets 49 and 59, of the oil pump 46 and the sleeve 40, respectively. The upper surface of the sleeve 40 is provided with two holes, 64 and 66, which are shaped to receive two pins which will be described in greater detail below. These two pins allow the sleeve 40 to be driven by the crankshaft in a manner which is independent of the driveshaft 36 shown in FIG. 4.

Figure 6:
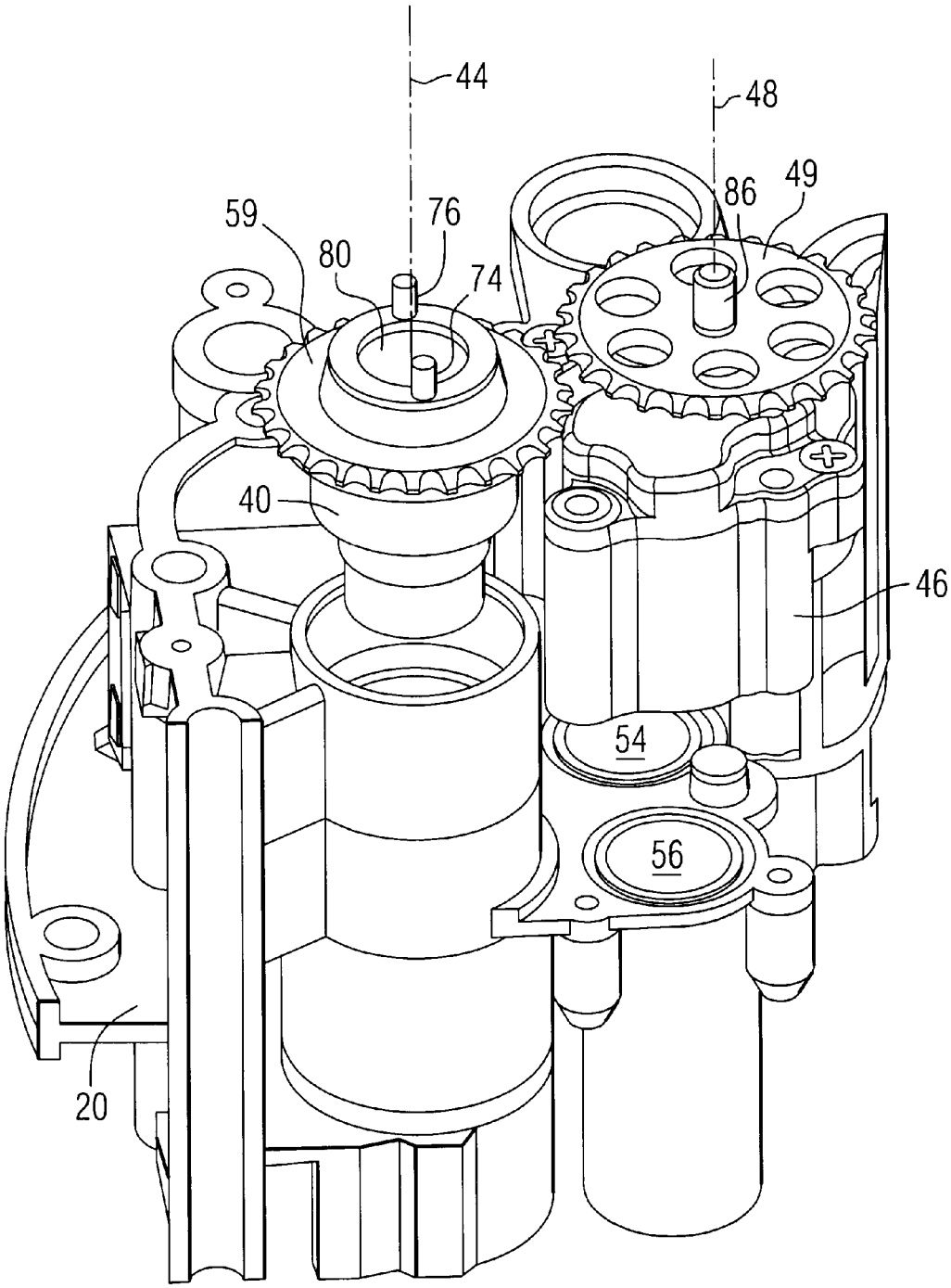
FIG. 6 is an isometric view of the present invention in combination with a section of an adapter plate.

FIG. 6 shows a section of the lubricating system, in an isometric exploded view. In FIG. 6, the chain 60 is not shown connected to the two chain sprockets, 49 and 59. Two pins, 74 and 76, are shown inserted into the holes, 64 and 66, described above in conjunction with FIG. 5. The two lubricating openings, 54 and 56, are also shown below the pump 46. The axes of rotation of the sleeve 40 and the rotor of the pump 46 are shown displaced from each other, as described above in conjunction with FIG. 4 and identified by reference letter X. A central opening 80 is provided in the sleeve 40 to allow a driveshaft to extend upward through the sleeve 40 and the adapter plate 20 for engagement with a crankshaft which is not shown in FIG. 6. It should be understood that the sleeve 40 is not associated in driving relation with a driveshaft and is free to rotate about the 20 common centerline 44 relative to the driveshaft 36. This allows the sleeve 40 and the rotor of the pump 46 to rotate independently of the driveshaft and in synchrony with each other when the chain 60 is connected to the chain sprockets, 49 and 59.

Figure 7:
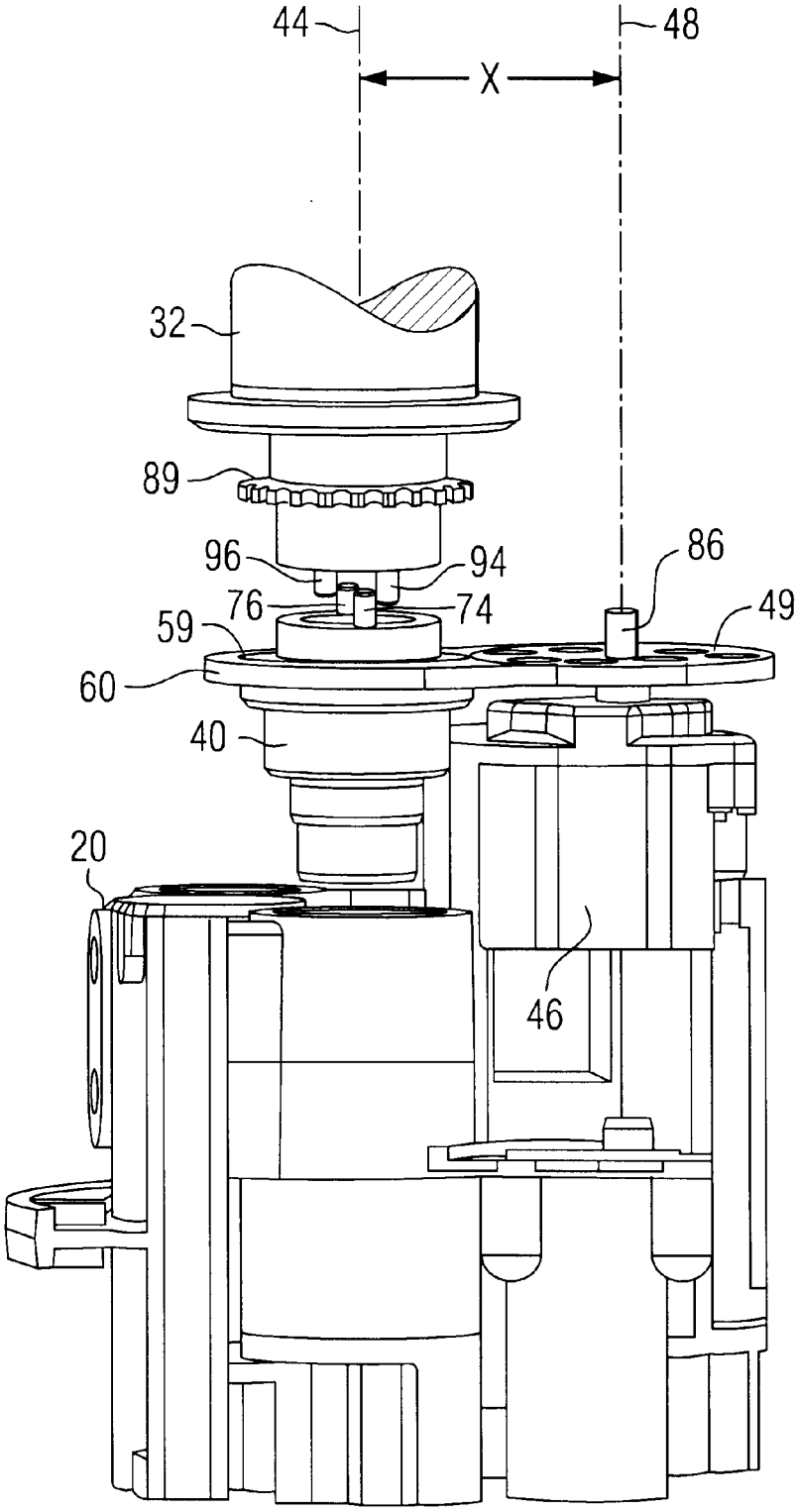
FIG. 7 shows the present invention in conjunction with a crankshaft and an adapter plate of an outboard motor.

FIG. 7 is an isometric exploded view of a portion of the adapter plate 20 with the sleeve 40 shown in relation to the crankshaft 32 of the engine 30 described above in conjunction with FIG. 4. The chain sprocket 59 of the sleeve 40 drives the chain sprocket 49 of the rotor of the pump 46 in association with chain 60. The shaft 86 of the pump 46 is attached to the rotor assembly of the pump (not shown in FIG. 7). The offset dimension X between the crankshaft axis 44 and the rotor axis 48 is shown in FIG. 7. An additional sprocket 89 is shown attached to the crankshaft 32 for the purpose of driving the camshaft 34 of the engine 30, but this crankshaft sprocket 89 is not directly related to the present invention and will not be described in detail herein.

With continued reference to FIG. 7, it can be seen that a pair of pins, 94 and 96, extend downwardly from the crankshaft 32 in a direction toward the sleeve 40. Although separated vertically because of the exploded nature of FIG. 7, it should be understood that pins 94 and 96 of the crankshaft 32 are located in a common plane with pins 74 and 76 of the sleeve 40. As a result, when the crankshaft 32 rotates about axis 44, it's pins (i.e. 94 and 96) will move into contact with the pins (i.e. 74 and 76) extending upward from the sleeve 40. This contact provides a force which causes the sleeve 40 to rotate in synchrony with the crankshaft 32. This, in turn, causes the chain sprocket 59 to rotate and, because of the presence of the chain 60, cause the chain sprocket 49 to rotate. This drives the rotor of the pump 46.

Figure 8:
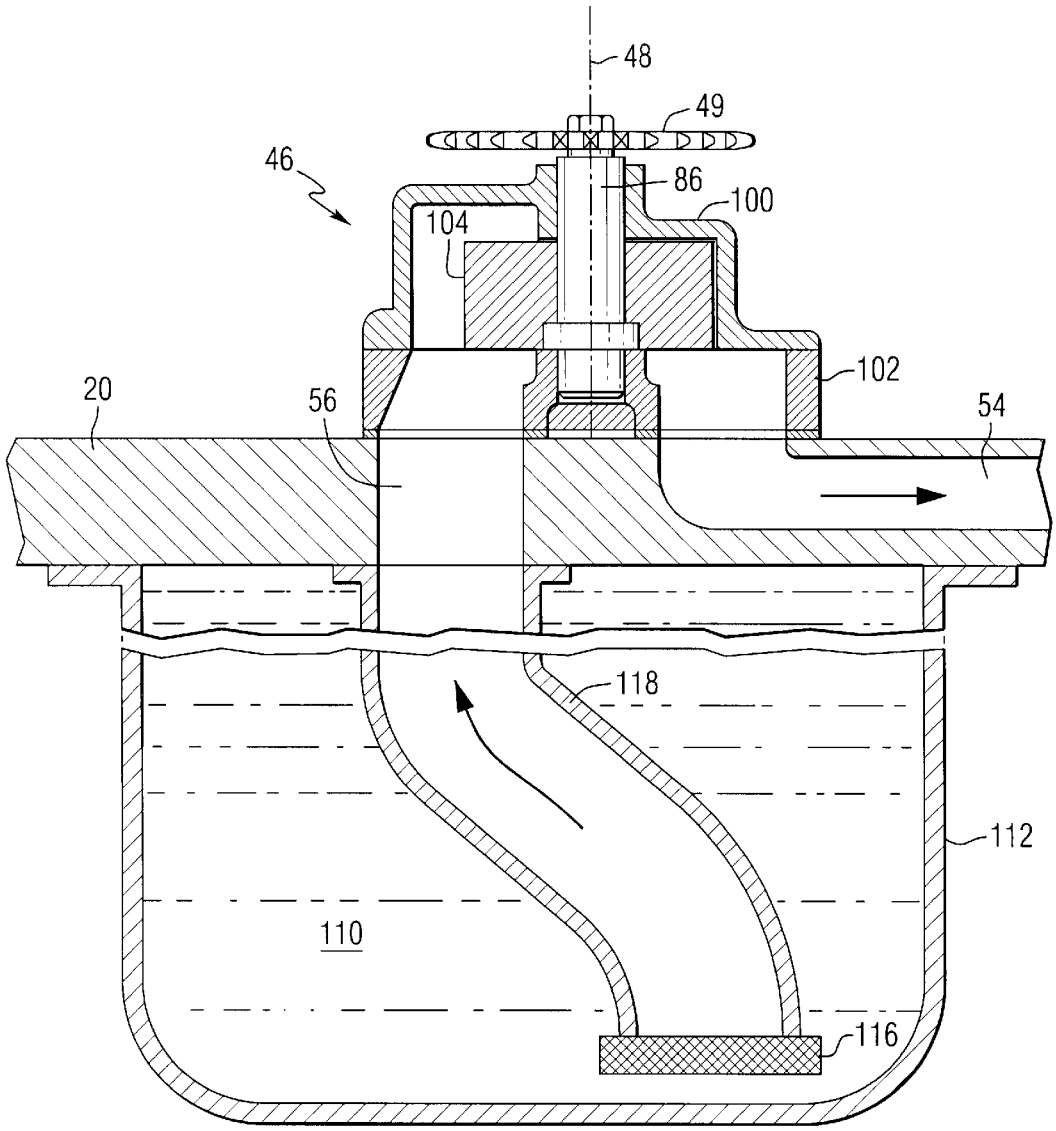
FIG. 8 is a section view showing a pump in association with an oil reservoir and oil conduits formed in an adapter plate of an outboard motor.

FIG. 8 is a section view of a pump 46 with a cover 100 attached to a base housing 102 and containing a rotor 104. A shaft 86 is rotatable about axis 48 which causes the rotor 104 to rotate about axis 48 within the housing structure of the pump 46. The pump 46 is placed over the two openings, 54 and 56, through the adapter plate 20. Rotation of the rotor 104 of the pump 46 draws oil 110 from an oil reservoir 112 which is supported below the adapter plate 20. In certain applications, a filter 116, or screen, is provided to inhibit debris in the oil 110 from being drawn into the pump 46. The sprocket 49 is shown attached to the shaft 86 of the pump 46 for rotation about axis 48. As described above, the use of chain sprocket 49 allows a chain to be connected to the chain sprocket 59 of the sleeve 40 for the purpose of transferring torque from the sleeve 40 to the rotor 104 of the pump 46.

As shown in FIG. 8, the pump 46 is used to draw oil 110 through a conduit 118 and pump the oil through outlet port 54 to various locations of the engine and related components for the purpose of providing lubricating fluid to those components.

With reference to FIGS. 4–8, the present invention provides an oil pump 46 which has an inlet port 56 and an outlet port 54. The oil pump 46 has a rotor 104 attached to a shaft 86 and supported for rotation about a first vertical axis 48. The outlet port 54 is connected in fluid communication with at least one lubricating conduit of the engine 30. An oil reservoir 112 is connected in fluid communication with the inlet port 56. An output shaft 32 of the engine is supported by the engine 30 for rotation about a second vertical axis and connected in torque transferring relation with the rotor 104 of the pump 46. The first and second axes, 44 and 48, are parallel and displaced from each other by a preselected distance X. A sleeve 40 is supported for rotation about the second axis 44. The rotatable sleeve 40 is connected in torque transferring relation between the output shaft 32 and the rotor 104 of the oil pump 46.

A first torque transferring protrusion, such as pins 94 and 96, are attached to the output shaft 32 and extend in a direction generally parallel to the second axis 44. A second torque transferring protrusion, such as pins 74 and 76, are attached to the sleeve 40. As a result of the relationship between the first and second torque transferring protrusions, rotation of the first torque transferring protrusion (e.g. pins 94 and 96) about the second axis 44 causes the first torque transferring protrusion to exert a force against the second torque transferring protrusion (e.g. pins 74 and 76). This force causes the sleeve 40 to rotate about the second axis 44.

A first chain sprocket 59 is attached to the sleeve 40 for rotation about the second axis 44. A second chain sprocket 49 is attached to the rotor 104 of the oil pump 46 for rotation about the first axis 48. A chain 60 is attached to the first and second chain sprockets, 59 and 49, for transferring torque from the sleeve 40 to the shaft 86 of the rotor 104 of the oil pump 46. The output shaft is a crankshaft 32 of the engine 30 in a preferred embodiment of the present invention. A driveshaft 36 is connected in torque transferring relation with the output shaft 32 for rotation about the second axis 44. The driveshaft 36 extends through an opening 80 in the sleeve 40 and the sleeve 40 is supported by the adapter plate 20 for rotation about the second axis 44.

With continued reference to FIGS. 4–8, it can be seen that rotation of the sleeve 40 is independent of the rotation of the driveshaft 36. The opening 80 is shaped to allow the driveshaft 36 to extend through the sleeve 40 for independent rotation resulting from the connection between the driveshaft 36 and the crankshaft 32. Although the sleeve 40 and the driveshaft 36 rotate in synchrony during normal operation of the engine 30, this synchronous rotation is due to the fact that both the driveshaft 36 and the sleeve 40 are driven by a common element (i.e. crankshaft 32). The arrangement described above allows the pump 46 to be located away from the axis of rotation of the crankshaft 32. This freedom of location allows the pump 46 to be located at a lower position and more proximate to the oil 110 in the reservoir 112.

Certain lubricating systems for marine engines known in the prior art drive the oil pump by the driveshaft 36, with the driveshaft being driven by the crankshaft. Since the driveshaft is a relatively long shaft extending from the crankshaft of the engine to the gear housing of the outboard motor, certain outboard motors exhibit significant flexing and twisting of the driveshaft. This flexing and twisting of the driveshaft can result in adverse consequences in the operation of the oil pump. Since the present invention provides an oil pump that is driven by the sleeve which is, in turn, driven directly by the crankshaft, these problems are avoided.

I claim:

1. A lubricating system for an engine, comprising:

an oil pump having an inlet port and an outlet port, said oil pump having a rotor supported for rotation about a first axis, said outlet port being connected in fluid communication with at least one lubricating conduit of said engine;

an oil reservoir connected in fluid communication with said inlet port;

an output shaft of said engine supported by said engine for rotation about a second axis and connected in torque transferring relation with said rotor of said oil pump, said first and second axes being displaced from each other by a preselected distance;

a sleeve supported for rotation about said second axis, said sleeve being connected in torque transferring relation between said output shaft and said rotor of said oil pump;

a first torque transferring protrusion attached to said output shaft and extending in a direction parallel to said second axis; and a second torque transferring protrusion attached to said sleeve, whereby rotation of said first torque transferring protrusion about said second axis causes said first torque transferring protrusion to exert a force against said second torque transferring protrusion, said force causing said sleeve to rotate about said second axis, said first torque transferring protrusion comprising a first pair of pins, said second torque transferring protrusion comprising a second pair of pins.

2. The lubricating system of claim 1, further comprising:

a first chain sprocket attached to said sleeve for rotation about said second axis;

a second chain sprocket attached to said rotor of said oil pump for rotation about said first axis; and a chain attached to said first and second chain sprockets for transferring torque from said sleeve to said rotor of said oil pump.

3. The lubricating system of claim 1, wherein:

said output shaft is a crankshaft of said engine.

4. The lubricating system of claim 1, further comprising:

a drive shaft connected in torque transferring relation with said output shaft for rotation about said second axis, said drive shaft extending through an opening in said sleeve.

5. The lubricating system of claim 1, wherein:

said oil pump is attached to an adapter plate of an outboard motor and said sleeve is supported by said adapter plate for rotation about said second axis.

6. A lubricating system for an engine, comprising:

an oil pump having an inlet port and an outlet port, said oil pump having a rotor supported for rotation about a first vertical axis, said outlet port being connected in fluid communication with at least one lubricating conduit of said engine;

an oil reservoir connected in fluid communication with said inlet port;

an output shaft of said engine supported by said engine for rotation about a second vertical axis and connected in torque transferring relation with said rotor of said oil pump;

a sleeve supported for rotation about said second vertical axis, said sleeve being connected in torque transferring relation between said output shaft and said rotor of said oil pump;

a first pair of pins attached to said output shaft and extending in a direction parallel to said second vertical axis; and a second pair of pins attached to said sleeve, whereby rotation of said first torque transferring protrusion about said second vertical axis causes said first torque transferring protrusion to exert a force against said second torque transferring protrusion, said force causing said sleeve to rotate about said second vertical axis.

7. The lubricating system of claim 6, wherein:

said first and second vertical axes are displaced from each other by a preselected distance.

8. The lubricating system of claim 7, further comprising:

a first chain sprocket attached to said sleeve for rotation about said second vertical axis;

a second chain sprocket attached to said rotor of said oil pump for rotation about said first vertical axis; and a chain attached to said first and second chain sprockets for transferring torque from said sleeve to said rotor of.said oil pump.

9. The lubricating system of claim 8, further comprising:

a drive shaft connected in torque transferring relation with said output shaft for rotation about said second vertical axis, said drive shaft extending through an opening in said sleeve.

10. The lubricating system of claim 9, wherein:

said oil pump is attached to an adapter plate of an outboard motor and said sleeve is supported by said adapter plate for rotation about said second vertical axis.

11. A lubricating system for an engine of an outboard motor, comprising:

an oil pump having an inlet port and an outlet port, said oil pump having a rotor supported for rotation about a first vertical axis, said outlet port being connected in fluid communication with at least one lubricating conduit of said engine;

an oil reservoir connected in fluid communication with said inlet port;

a output shaft of said engine supported by said engine for rotation about a second vertical axis and connected in torque transferring relation with said rotor of said oil pump, said first and second vertical axes being displaced from each other by a preselected distance;

a sleeve supported for rotation about said second vertical axis, said sleeve being connected in torque transferring relation between said output shaft and said rotor of said oil pump;

a first torque transferring protrusion attached to said output shaft and extending in a direction parallel to said second vertical axis;

a second torque transferring protrusion attached to said sleeve, whereby rotation of said first torque transferring protrusion about said second vertical axis causes said first torque transferring protrusion to exert a force against said second torque transferring protrusion, said force causing said sleeve to rotate about said second vertical axis;

a first chain sprocket attached to said sleeve for rotation about said second vertical axis; a second chain sprocket attached to said rotor of said oil pump for rotation about said first vertical axis;

a chain attached to said first and second chain sprockets for transferring torque from said sleeve to said rotor of said oil pump; and a drive shaft connected in torque transferring relation with said output shaft for rotation about said second vertical axis, said drive shaft extending through an opening in said sleeve, said oil pump being attached to an adapter plate of said outboard motor.

12. The lubricating system of claim 11, wherein:

said first torque transferring protrusion comprises a first pair of pins; and said second torque transferring protrusion comprises a second pair of pins.

13. The lubricating system of claim 11, wherein:

said output shaft is a crankshaft of said engine.

14. The lubricating system of claim 11, wherein:

said sleeve is supported by said adapter plate for rotation about said second vertical axis.

* * * * *